US011371267B2

(12) United States Patent
Steffen et al.

(10) Patent No.: US 11,371,267 B2
(45) Date of Patent: Jun. 28, 2022

(54) MOTOR VEHICLE LOCK WITH ROTARY LATCH SUPPORT

(71) Applicant: Kiekert AG, Heiligenhaus (DE)

(72) Inventors: Tobias Steffen, Essen (DE); Thomas Heide, Essen (DE)

(73) Assignee: Kiekert AG, Heiligenhaus (DE)

( * ) Notice: Subject to any disclaimer, the term of this patent is extended or adjusted under 35 U.S.C. 154(b) by 544 days.

(21) Appl. No.: 16/065,154

(22) PCT Filed: Nov. 30, 2016

(86) PCT No.: PCT/DE2016/100560

§ 371 (c)(1),
(2) Date: Jun. 22, 2018

(87) PCT Pub. No.: WO2017/108024

PCT Pub. Date: Jun. 29, 2017

(65) Prior Publication Data

US 2019/0003212 A1 Jan. 3, 2019

(30) Foreign Application Priority Data

Dec. 22, 2015 (DE) ..... 10 2015 122 587.5

(51) Int. Cl.
*E05B 77/04* (2014.01)
*E05B 77/10* (2014.01)
(Continued)

(52) U.S. Cl.
CPC ..... *E05B 77/04* (2013.01); *E05B 77/10* (2013.01); *E05B 85/243* (2013.01); *E05B 79/04* (2013.01)

(58) Field of Classification Search
CPC ..... E05B 77/10; E05B 77/04; E05B 85/24; E05B 51/023; E05B 57/00;
(Continued)

(56) References Cited

U.S. PATENT DOCUMENTS 4,258,945 A * 3/1981 Pouget ..... E05B 77/48 292/201
4,756,563 A * 7/1988 Garwood ..... E05B 85/243 292/216
(Continued)

FOREIGN PATENT DOCUMENTS

DE 2753078 A1 6/1978
DE 2942429 A1 4/1980
(Continued)

OTHER PUBLICATIONS

"Direct," Merriam-Webster Dictionary (Year: 2020).*
(Continued)

*Primary Examiner* — Kristina R Fulton
*Assistant Examiner* — Emily G. Brown
(74) *Attorney, Agent, or Firm* — Renner, Otto, Boisselle & Sklar, LLP

(57) ABSTRACT

A motor vehicle lock including a rotary latch and a pawl for latching the rotary latch in a latching position, in particular main latching position, and also a lock plate with a screw-on point for attaching the motor vehicle lock to a vehicle door or vehicle flap, wherein the rotary latch comprises a support which is provided in such a manner that, in the latching position, in particular main latching position, the rotary latch can be supported on the screw-on point via the support in the event of an overload. Opening of a vehicle door or flap can thus be avoided even in the event of a crash.

16 Claims, 3 Drawing Sheets

(51) Int. Cl.
*E05B 79/04* (2014.01)
*E05B 85/24* (2014.01)

(58) Field of Classification Search
CPC ..... E05B 2063/0026; E05B 85/243; E05B 79/04; B60R 2021/0002; B60R 2021/0039; Y10T 292/1047
USPC ..... 292/216
See application file for complete search history.

(56) References Cited

U.S. PATENT DOCUMENTS

| | | | | |
|---|---|---|---|---|
| 6,471,260 | B1 * | 10/2002 | Weinerman | E05C 3/24 292/143 |
| 6,886,222 | B2 * | 5/2005 | Vitry | E05B 77/04 16/349 |
| 7,195,292 | B2 * | 3/2007 | Ketelsen | E05B 85/26 292/201 |
| 8,757,683 | B2 * | 6/2014 | Schiffer | E05B 77/36 292/216 |
| 10,844,641 | B2 * | 11/2020 | Schiffer | E05B 77/36 |
| 11,162,284 | B2 * | 11/2021 | Ottino | E05B 81/34 |
| 2003/0094818 | A1 * | 5/2003 | Tomaszewski | E05B 81/16 292/216 |
| 2011/0133491 | A1 * | 6/2011 | Perkins | E05B 77/10 292/216 |
| 2014/0292002 | A1 * | 10/2014 | Graute | E05B 77/34 292/195 |
| 2015/0076837 | A1 * | 3/2015 | Rosales | E05B 85/26 292/198 |
| 2015/0145262 | A1 * | 5/2015 | Gotzen | E05B 77/10 292/194 |
| 2015/0191947 | A1 * | 7/2015 | Philippe | E05B 77/38 292/195 |
| 2016/0177599 | A1 * | 6/2016 | Nozawa | E05B 85/243 292/164 |

FOREIGN PATENT DOCUMENTS

| | | | | |
|---|---|---|---|---|
| DE | 10200551 | A1 * | 7/2003 | E05B 77/04 |
| DE | 202005020452 | | 5/2007 | |
| DE | 102009029014 | | 3/2011 | |
| DE | 102009029025 | | 3/2011 | |
| DE | 102009029025 | A1 * | 3/2011 | E05B 17/0062 |
| DE | 102012023261 | A1 | 6/2014 | |
| DE | 202014105876 | | 2/2015 | |
| DE | 102013114301 | | 6/2015 | |
| DE | 102013114301 | A1 * | 6/2015 | E05B 77/38 |
| DE | 102014115704 | A1 * | 3/2016 | E05B 77/10 |
| EP | 2851494 | | 3/2015 | |
| GB | 1296556 | | 11/1972 | |
| JP | 2013117115 | A2 | 6/2013 | |

OTHER PUBLICATIONS

"Proximity," Merriam-Webster Dictionary (Year: 2020).*
"Adjust," Lexico.com, Oxford University Press (Year: 2020).*
Oxford U.S. Dictionary, "Point," accessed Mar. 31, 2021, Lexico.com, https://www.lexico.com/en/definition/point (Year: 2021).*
Tony Atkins and Marcel Escudier, A Dictionary of Mechanical Engineering, 2013, Oxford University Press, 1st Edition (Year: 2013).*
Austin Weber, impact Riveting: Using Loose Rivets, Feb. 1, 2001, Assembly Magazine, https://www.assemblymag.com/articles/83850-using-loose-rivets (Year: 2001).*
English Summary of Office Action issued in counterpart Japanese Patent Application No. 2018-532570 dated Jun. 23, 2020.
International Search Report and Written Opinion for corresponding Patent Application No. PCT/DE2016/100560 dated Mar. 9, 2017.

* cited by examiner

MOTOR VEHICLE LOCK WITH ROTARY LATCH SUPPORT

FIELD OF INVENTION

The invention relates to a motor vehicle lock comprising a rotary latch and a pawl for latching the rotary latch.

BACKGROUND OF INVENTION

A motor vehicle lock in particular has a metallic lock plate or a metallic lock case with a lock plate with a locking mechanism accommodated thereon or therein with the rotary latch and the pawl. The lock plate is generally equipped with an inlet slot, by means of which a locking bolt of a motor vehicle door or flap can reach into the motor vehicle lock in order to be accommodated by the pivotably mounted rotary latch of the locking mechanism in an inlet slot of the rotary latch which is generally formed by an arresting arm and a load arm and held by latching of the pawl with the rotary latch.

If a crash leads to a motor vehicle door attempting to open, the locking bolt thus exerts relevant force on the load arm of the rotary latch. This force can exceed the loads exerted in normal operation to such an extent that the pivot bearing of the rotary latch fails and the rotary latch can thus be released from the main latching position so that opening of the motor vehicle door can occur.

The pivot bearing of the rotary latch which enables rotation of the rotary latch around the rotary latch axis is frequently provided by an axis of the rotary latch or shaft riveted with the lock plate. In the case of an aforementioned overload in the case of a crash, for example, the rivet head can break free. The axis of the rotary latch or the shaft can thus tip from the position orthogonal to the lock plate.

Furthermore, due to the overload acting on the pivot bearing and/or due to the tipping the circular boring of the pivot bearing or on the rivet point by the lock plate can be extended into a lengthwise hole, whereby a translational shifting of the rotary latch can occur. Such a change in the position of the rotary latch in the lock can lead to gliding of the pawl from the rotary latch in turn, i.e. loosening of the rotary latch from the main latching position.

The individual components of a locking mechanism are therefore constructed so stable on a conventional motor vehicle lock that they can not only cope with daily operation, but also with sudden impacts and overload in a crash, for example.

The publication DE 10 2009 029 025 A1 discloses a motor vehicle lock with a bolt 10 attached to the lock case wall 16 to support the rotary latch in the case of a crash. However, a crash can lead to deformation of the lock case wall, in principle.

The publication DE 10 2009 029 014 A1 discloses a motor vehicle lock with an extension 5 to a rotary latch to support the lock case wall. This solution has the same disadvantage as the solution according to the publication.

The publication DE 20 2014 105 876 U1 discloses a motor vehicle lock reinforced with the aid of a blocking element 50 which connects several axes 76, 78 and has a boom 52 which deforms inwards in the case of a crash in order to block the ratchet 38. By means of deformation of the axes in the case of a crash the reinforcing effect is limited by the blocking element 50, however.

SUMMARY OF INVENTION

The aforementioned features known from the state of the art can be combined individually or in any combination with one of the objects according to the invention described hereafter.

It is an object of the invention to provide a further developed motor vehicle lock.

A motor vehicle lock according to the main claim solves the object. Advantageous embodiments result from the sub-claims.

To solve the object, a motor vehicle lock is provided, comprising a rotary latch and a pawl for latching the rotary latch in a latching position, in particular a main latching position, and also a lock plate and/or a lock case with a screw-on point to attach the motor vehicle lock to a motor vehicle door or motor vehicle flap, where the rotary latch has a supporting means which is designed such that in the case of an overload the rotary latch can support the screw-on point by means of the supporting means in the latching position, especially the main latching position.

A lock case in its simplest form is a lock plate with an upright wall or lock case wall. A lock plate and a lock case are generally made of metal or sheet metal. A lock case can be produced by stamping and bending of sheet steel.

In a latching position the rotary latch is ratcheted by the pawl and is thus held or arrested in the latching position until the pawl is loosened in a scheduled manner. The latching position can be a pre-ratchet position, a main ratchet position or another latching position provided for.

A screw-on point generally has at least a screw-on opening to connect the lock plate with the chassis of a motor vehicle, i.e. especially with a motor vehicle door.

The invention is based on the insight that the connection of the generally metallic lock plate with the motor vehicle door by screwing constitutes an especially robust and frequently even the most mechanically stable connection of the motor vehicle lock.

A rotary latch, which in the latching position, in particular the main latching position, can support itself in the case of an overload on a screw-on point by means of a supporting means enables with particular reliability, even in the case of a crash, the counteracting of unwanted opening of the motor vehicle lock and thus unscheduled opening of a door or flap of a motor vehicle. This safety can also be attained with a reduced sheet thickness of the lock plate.

Supporting counteracts a tipping movement of an axis of the rotary latch or a pivot bearing and thus extension of the pivot bearing boring into a lengthwise hole. Although slight tipping and other slight shifting of the rotary latch may occur until the supporting means impacts against the screw-on point as an end stop and comes to a rest there. This slight change in position is normally insufficient to glide the pawl from the rotary latch and to be able to loosen the latching. In the case of a pivot bearing generated by riveting a breaking off of a rivet head can furthermore generally be prevented.

A dual function is therefore assigned to the screw-on point, namely connection of the motor vehicle lock with the vehicle and supporting of the rotary latch. A screw-on point is additionally generally also closer than a lock case wall, whereby especially close supporting can be attained to the rotary latch. An especially reliable and safe motor vehicle lock can thus be provided.

In one embodiment, the rotary latch forms a supporting protrusion as the supporting means.

The supporting protrusion is in particular connected to the rotary latch in a firmly bonded manner. The rotary latch and the supporting protrusion are preferably made of a piece of material, in particular by plastic injection molding. The rotary latch, including the supporting process, are made of plastic in principle.

By means of a supporting protrusion as a supporting means, especially reliable force transmission is possible from the screw-on point to the rotary latch and from the screw-on point via the rotary latch to the pivot bearing on the lock plate, in particular in the area of the pivot bearing boring, with little additional production costs.

Breaking off of the pivot bearing or an unwanted change in position of the rotary latch with the risk of loosening of the latching and the unscheduled leaving of the latching position, in particular of the main latching position, can thus be counteracted especially effectively.

In one embodiment, the supporting means or the supporting protrusion is located in the latching position, in particular the main latching position, in direct spatial proximity to the screw-on point.

In direct spatial proximity means that a surface of the supporting means turned towards the screw-on point from the surface of the screw-on point which is turned towards the supporting means is arranged in direct spatial proximity without interposed parts of the motor vehicle lock.

It thus enables the supporting means or the supporting protrusion to preferably only the touch the screw-on point when the axis of the rotary latch or the pivot bearing is deformed due to excessive forces. The distance between the screw-on point and the supporting means or the supporting protrusion is selected in such a way that the rotary latch axis and the pivot bearing only deform slight in the case of stress, but do not tip, break or loosen from the lock plate. A lateral supporting—viewed laterally in the rotational plane of the rotary latch—of the rotary latch against the screw-on point is hereby attained which, in the case of overload, such as in the event of a crash or under extreme stress such as an accident with a side impact, for example, deflects the forces acting on the rotary latch by means of the locking bolt onto the screw-on point.

This also contributes to the rotary latch also remaining pivotably mounted in the case of accident and opening the motor vehicle lock and thus the motor vehicle door or flap.

In one embodiment, the screw-on point is designed as a sheathing of a screw-on opening protruding from the lock plate.

The lock plate can be part of a lock case as described above. A lock plate extends in principle flatly and predominantly even in principle. Protruding from the lock plate therefore means in the direction above the lock plate or predominantly orthogonal to the lock plate plane.

The sheathing of a screw-on opening can be a cylindrical, cone-shaped and/or funnel-shaped part of the lock plate which expands upwards from the lock plate which surrounds or forms the screw-on opening, in particular produced by pressing, stamping, deep drawing or reshaping. A screw-on opening is preferably a passage opening and holds a screw. In particular, a screw-on opening can be executed with or without a thread, preferably in a cylindrical part.

A screw is generally inserted and screwed from the motor vehicle chassis side by a boring in the motor vehicle chassis during installation, e.g. motor vehicle door, and then through the screw-on opening. The screw-on opening is filled by the screw so that in the case of a crash the sheathing can support the screw which is regularly dimensioned for overload situations in particular in a dimensionally stable manner and led and held by the motor vehicle chassis and the screw-on opening or sheathing. The sheathing is therefore especially dimensionally stable in the case of a crash.

The guide length is increased for the screw and an especially stable fit is created for the screw by the protrusion of the sheathing. The protrusion offers an adequate stop contour to support the supporting means so to speak.

A cylindrical sheathing or a cylindrical part of the sheathing enables an increased guide length and is especially suitable for the insertion of a thread. A cone-shaped sheathing or a cone-shaped part of the sheathing enables a mechanically especially effective load deflection. This can contribute to particularly high stability of the screw-on point. In addition, the cone shape simplifies installation by means of simplified threading of the screw. A funnel shape or a reverse funnel shape viewed from the lock plate combines the aforementioned advantages of the cylindrical shape and the cone shape with the additional effect that can provide an especially large stop surface for the stop means.

An especially reliable and stable supporting of the rotary latch can thus be enabled.

In one embodiment, the supporting means can be supported in particular partially or wholly to a screw on the screw-on point.

A screw with a screw head and an opposite screw end is generally screwed into the screw-on opening of the screw-on point that the screw end protrudes inside the motor vehicle lock, i.e. extends upwards viewed from the lock plate and protrudes upwards out of the screw-on opening. This protruding screw end can also advantageously act as an end stop to support the supporting means. Because, as described above, the screw is regularly dimensioned with special robustness. But the opposite scenario can also be advantageous, namely that the supporting means is supported on the screw head, whereby the screw is inserted and screwed by the lock plate in this case.

Furthermore, supporting of a supporting means on a nut above or on the screw opening can furthermore be executed for especially reliable and stable supporting.

In one embodiment, the supporting means is adjusted to an opposite contour of the screw-on point and/or has a corresponding contour.

Adjusted to a contour means that the supporting means is shaped such that the supporting means does not glide on the screw-on point. A lance-shaped supporting means would not be adjusted to supporting on a cone shape, for example.

A contour of the supporting means corresponding to the screw-on point means a parallel contour, in particular viewed from the rotary latch axis in the direction of the screw-on point parallel to the lock plate plane. A corresponding contour permits a maximum flat contact line or contact area, i.e. touch line or touch area, during supporting and thus especially reliable and stable supporting.

In particular, the shortest distance or a gap width between the supporting means and the screw-on point, i.e. the contour of the screw-on point turned towards the supporting means, i.e. in particular the sheathing, is at least one third, preferably one sixth and/or a maximum of one-tenth, preferably eight tenths of the diameter of the screw-on opening.

The shortest distance or a gap width between the supporting means and the screw-on point is preferably at least one quarter, preferably one half and/or a maximum of double, preferably a single factor of the sheet thickness or the thickness of the lock plate.

The shortest distance or a gap width between the supporting means and the screw-on point is preferably at least 0.3 mm, preferably 0.5 mm, and/or a maximum of 3 mm, preferably a maximum of 2 mm.

Breaking, tipping or failure of the axis of the rotary latch or the pivot bearing can thus be prevented and simultaneously smooth normal operation—i.e. with a normal load—can thus be ensured in which the supporting means does not collide with or touch the screw-on point.

In one embodiment, the supporting means or the supporting protrusion is arranged on the load arm of the rotary latch. The function of a customary load arm of a rotary latch is described in more detail hereafter. The load arm is in the latching position, in particular the main latching position, between the locking bolt and the inlet of the inlet slot of the lock plate and thus holds the locking bolt in the inlet slot of the rotary latch, i.e. in the motor vehicle lock.

In the case of a crash, a centrifugal force usually acts on a motor vehicle door or flap in the opening direction of the motor vehicle door or flap, so that the locking bolt is subjected to a force in the direction of the inlet of the inlet slot of the lock plate which is generally larger than the usual force in normal daily operation. This force is brought on the load arm which can lead to deformation, rotation and/or shifting of the load arm or the rotary latch, sometimes including deformation, breakage or failure of the axis of the rotary latch or the pivot bearing. The supporting means or the supporting protrusion is so exactly arranged to the part of the rotary latch, that the supporting load arises or is initiated into the rotary latch.

By arrangement of the supporting means or the supporting protrusion on the load arm of the rotary latch, the force to be transmitted only needs to cross the load arm and the supporting means. Other areas of the rotary latch are thus hardly directly affected. Centrifugal forces on the locking bolt can thus be especially effectively absorbed and deflected by supporting on the screw-on point without a locking mechanism component being excessively deformed and/or the locking mechanism releasing the locking bolt in an unscheduled and unwanted manner.

In particular, the supporting means or the supporting protrusion is laterally arranged on the load arm, preferably viewed in the rotational plane of the rotary latch. A supporting force can thus be especially effective and deflected by the rotary latch with especially slight deformation.

In one embodiment, the supporting means extends radially or predominantly radially to the rotary latch axis of the rotary latch. An extension of the supporting means in the direction of an overload can thus execute especially effective supporting with an especially slim supporting means.

In one embodiment, the radial extension of the supporting means corresponds to at least 0.5-fold, preferably 0.8-fold and/or a maximum of 2.0-fold, preferably 1.5-fold, preferably 1.2-fold of the diameter of the screw-on opening. Especially great robustness and deformation stiffness can thus be enabled during supporting.

In one embodiment, the supporting means extends on a radial side in an arched shape in a circumferential direction to the rotary latch axis. A rotation of the rotary latch in normal operation without collision can thus be ensured with the screw-on point.

In particular, the supporting means extends to a radial side in an arched shape in a circumferential direction to the rotary latch axis with expansion in the circumferential direction of at least 1.0-fold and/or a maximum of 2.0-fold of the diameter of the screw-on opening or the sheathing.

Especially great robustness and deformation stiffness can thus be enabled during supporting.

In one embodiment, a thickness of the supporting means is less than a thickness of the rotary latch. The thickness of the supporting means preferably corresponds to at least 0.5-fold, preferably 0.7 fold, especially preferably 0.9 fold the thickness of the rotary latch, in particular a maximum thickness viewed over the entire rotary latch.

Thickness is to be measured in particular in the direction of the rotary latch axis.

Such a thick supporting means can attain sufficiently great supporting during overload with simultaneously reduced material use and weight.

In one embodiment, the screw-on point lies on one side of a rotary latch axis which is turned towards an inlet of an inlet slot of the lock plate. Thus, especially effective supporting can be enabled to accommodate overloads and centrifugal forces which are transmitted via a locking bolt on the rotary latch or the load arm of the rotary latch.

In one embodiment, a pivot bearing of the rotary latch or an axis of the rotary latch is constituted or mounted by a rivet connection with the lock plate.

Rotary latch axis means a predominantly cylindrical axis.

A rotary latch axis or a pivot bearing can be suspended or connected to a lock plate by means of a rivet connection at especially low cost. Undoing or failure of the rivet connection while providing of an especially low sheet thickness of the lock plate can be prevented by the supporting means according to the invention.

In particular, the lock plate or a lock case can thus be produced with the sheet metal lock plate which, as a sheet thickness preferably of a maximum of one half, preferably a maximum of one third, especially preferably a maximum of one quarter of the thickness of the rotary latch. A sheet thickness of a maximum of 2 mm, preferably 1.5 mm, can be provided for in particular.

BRIEF DESCRIPTION OF DRAWINGS

Exemplary embodiments of the invention are explained in further detail hereinafter on the basis of figures. Features of the exemplary embodiment can be individually or jointly combined with the claimed object.

The following are shown.

DETAILED DESCRIPTION

The motor vehicle lock shown encompasses a metallic lock case, with a lock plate 3 and a lock case wall 12 which was produced by bending one end of the lock plate 3 or was connected as a separate part with the lock plate 3. The locking mechanism with the rotary latch 1 and the pawl 2 is mounted on the lock plate 3.

Figure 3:
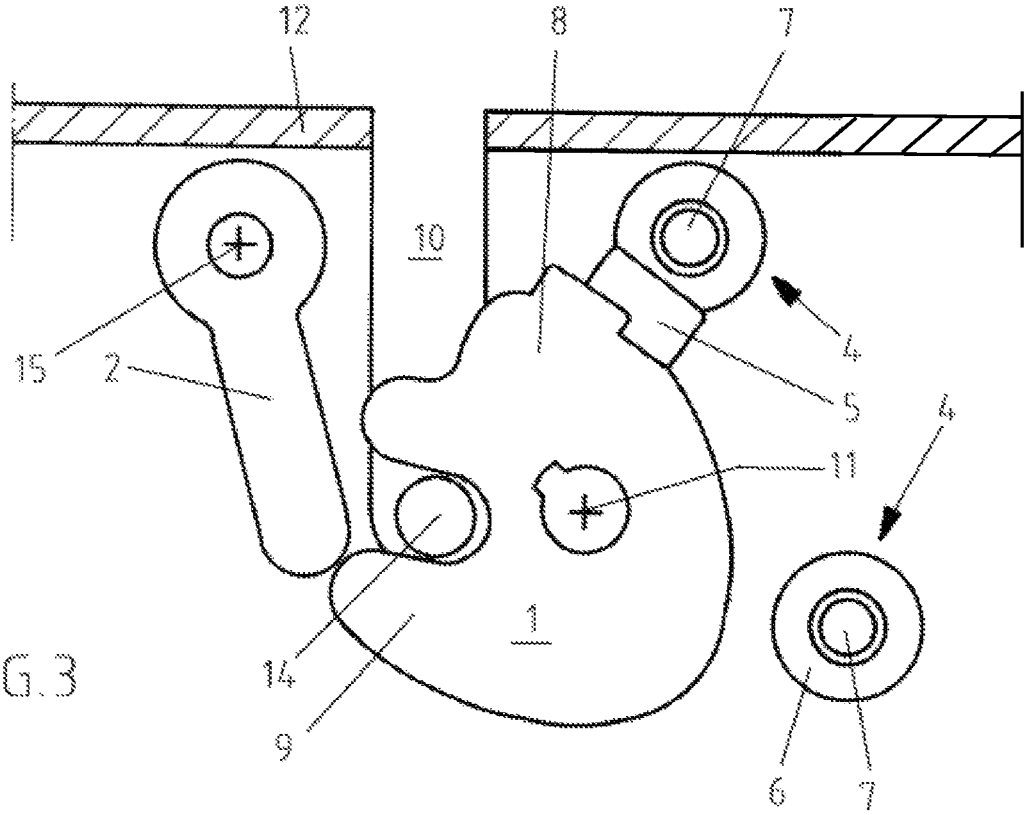
FIG. 3: Diagrammatic illustration of a top view of the lock plate from the inside in the main latching position
Figure 4:
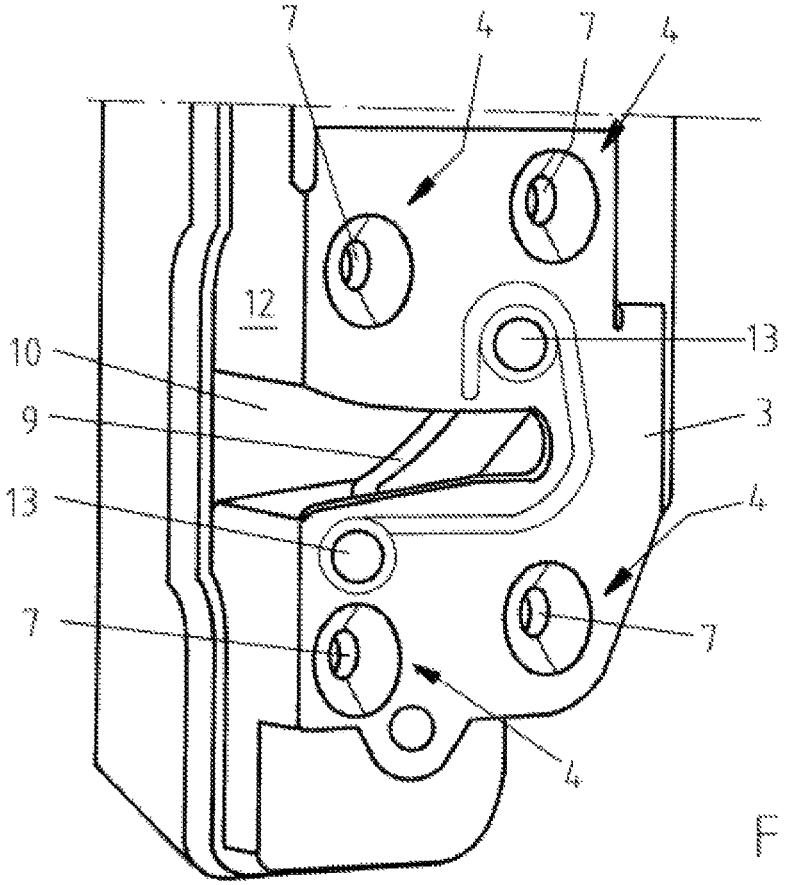
FIG. 4: Motor vehicle lock in the opening position

The rotary latch 1 has a rotary latch axis 11 which is connected in particular like the pawl 2 with a rivet connection with a rivet head 13 with the lock plate 3, whereby the rivet head 13 has a larger diameter than a boring on an external side of the lock plate 3 on the rivet point—covered by the rivet head 13 in FIG. 4—behind which the axis is preferably located in turn, which also has a larger diameter than the boring in principle. A pivot bearing for the rotary latch 1 and/or the pawl 2 is thus executed especially simply. The lock plate 3 is equipped with an inlet slot 10 of the lock plate 3, by means of which a locking bolt 14 (FIG. 3) can reach into the motor vehicle lock in order to be accommodated by the pivotably mounted rotary latch 1 of the locking mechanism and to be held by ratcheting of the pawl 2 with the rotary latch 1.

Figure 1:
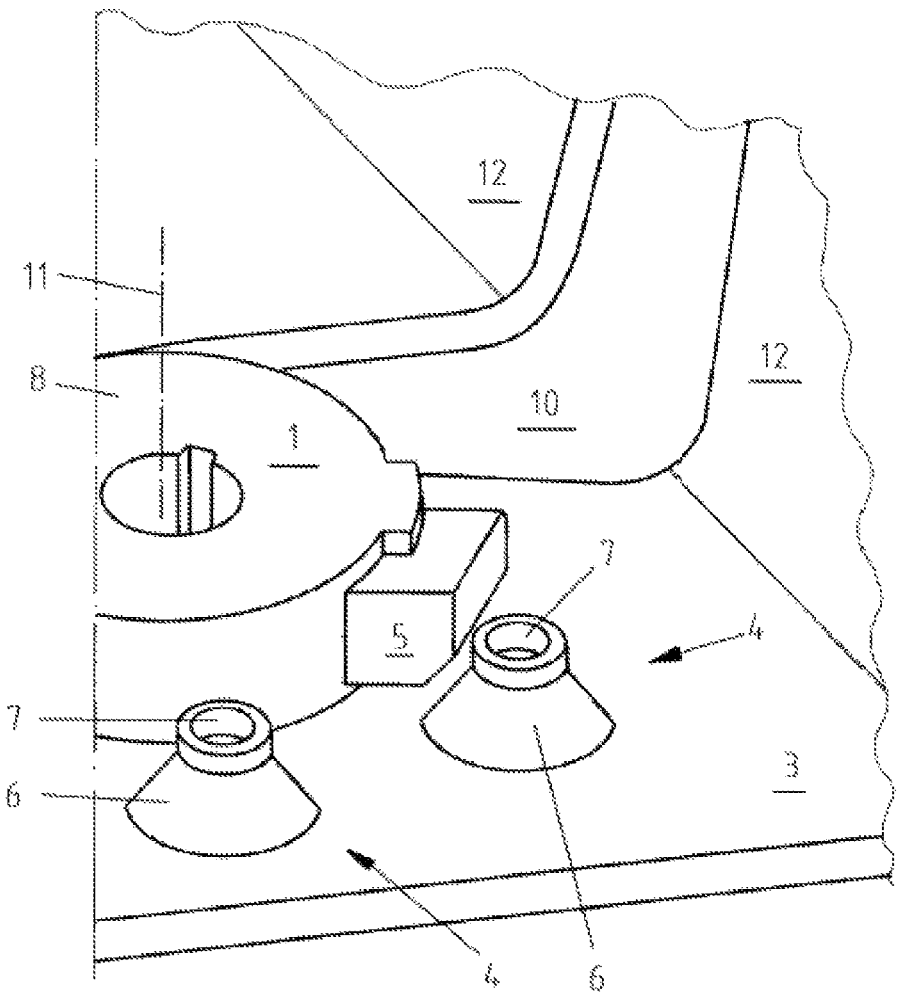
FIG. 1: Illustration of the inside of a motor vehicle lock in the main latching position
Figure 2:
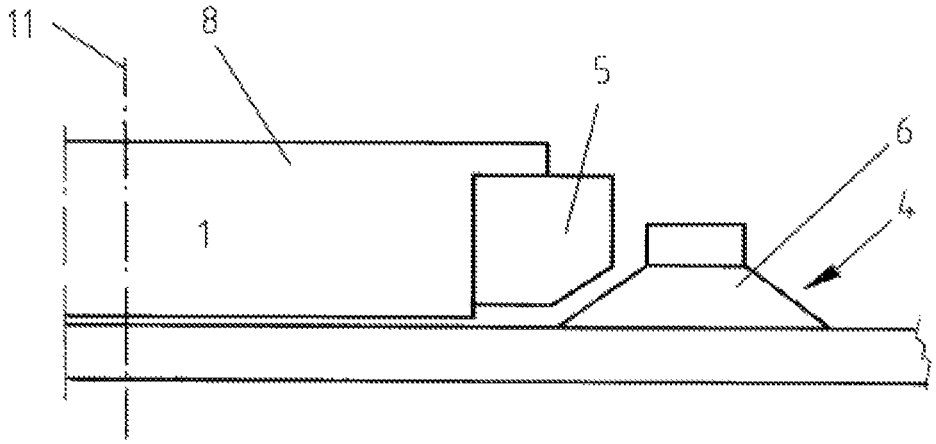
FIG. 2: Lateral view of the supporting protrusion and screw-on point inside the motor vehicle lock in the main latching position

The rotary latch 1 of the motor vehicle lock usually has a load arm 8 and an arresting arm 9 which together form a fork-shaped inlet slot of the rotary latch 1, in which a locking bolt 14 of a motor vehicle door or flap, for example a hood or a trunk flap, goes during passage of the inlet slot 10 of the lock plate 3 if the motor vehicle door or flap is locked. The locking bolt 14 then rotates the rotary latch 1 from an opening position (FIG. 4) to a locked position (FIGS. 1 to 3). If the rotary latch 1 has reached the locked position, it is ratcheted via the pawl 2 in this position.

The locking bolt 14 can no longer leave the inlet slot of the rotary latch as the way is blocked by the load arm 8. This latching position is called a main latching position.

In one embodiment, the motor vehicle lock has a second latching position, namely the so-called pre-latching position. The purpose of the pre-ratcheting position is to intercept the relevant door or flap if it does not reach the main latching position during closure. In the pre-ratcheting position the rotary latch 1 is consequently not completely locked, however, an opening movement of the rotary latch 1 is already prevented by a pawl 2. Therefore, the area of the rotary latch 1 which accommodates the pawl 2 in this position is called pre-ratchet. Finally, in the main latching position the rotary latch 1 is completely locked. The pre-latching is therefore a transitional state between the open state and the main latching and is provided for safety reasons.

In one embodiment, the motor vehicle lock has a blocking lever (not illustrated) in addition to the pawl to hold the pawl 2 in the main latching position. In the case of a motor vehicle lock so designed, the relative position between the rotary latch 1 and the pawl 2 is not formed in such a way that the force exerted by the rotary latch 1 runs through the pawl rotational axis 15 and consequently enables independent fixing of the rotary latch 1 by means of the pawl 2.

Instead, in particular to provide an especially low-noise lock unit, the pawl 2 is formed or arranged such that the force exerted by the rotary latch 1 causes torque on the pawl 2 which favors release of the rotary latch 1. To this extent, the rotary latch 1 causes an opening moment with regard to the first pawl 2, so that it can easily be moved into the open position as a result of spring pre-tensioning of the rotary latch 1.

In order to guarantee a durable bolted state equally, the blocking lever is provided for which fixes the pawl 2 in the bolting position so that in particular shifting of position in relation to the locking mechanism—for example, by compression of the door seals, the driving operation and such like—cause no opening of the lock unit or no loosening of the contact of the pawl 2 and the rotary latch 1. The "self-opening mechanism" of the locking mechanism is thus blocked. Opening of the lock is thus possible with especially little expenditure of force.

In FIG. 3, the locking bolt 14 is held in a main latching position, i.e. in the closure position of the motor vehicle door or flap, by the load arm 8. In the case of a crash, centrifugal forces act on the locking bolt 14 in the direction of the lock case wall 12 or in the direction of the inlet of the inlet slot 10 of the lock plate 3.

In this direction, a screw-on point 4 is located at a certain distance from the customary radial circumferential contour of the rotary latch 1, so that the rotary latch 1 does not impact against the screw-on point 4 during rotation around the rotary latch axis 11.

Exactly this distance is now, as shown in FIGS. 1, 2 and 3, bridged by the supporting protrusion 5 of the rotary latch 1 at a ratio of at least 80% or 90% of the total distance between the supporting protrusion 5 and the screw-on point in such a way that a gap remains directly between the supporting protrusion 5 and the screw-on point 4. In normal operation, this gap enables unimpeded rotation of the rotary latch 1.

However, in the case of overload, the forces transmitted by means of the locking bolt 14 onto the rotary latch 1 cause a deformation, shifting or tipping of the rotary latch axis 11, the pivot bearing or the rotary latch 1 itself only in such a way that the gap is locked.

Due to this upper limit of the deformation, shifting or tipping unscheduled loosening of the latching between the pawl 2 and the rotary latch 1 or in an embodiment of the blocking lever of the pawl 2 and/or the rotary latch 1 can be prevented. Therefore the locking bolt 14 is always fixed in the main latching position safely in the case of overload. Unwanted opening of a door or flap during a crash and wanted opening of a door or flap after the crash to leave the driver's cabin can thus be enabled. The latter demands that the rotary latch 1 remains pivotable, even after an overload. The suspension or mounting or rivet connection of the rotary latch axis 1 or shaft are namely generally not damaged in such a way by means of the aforementioned limitation of the deformation, shifting or tipping such that the rotary latch 1 can no longer be brought from a locked position into an open position.

As shown in FIG. 1, the external contour of the supporting protrusion 5 is adjusted to the contour of the funnel-shaped sheathing 6 of the screw-on point 4 so that a lining which is as flat as possible and thus uniform load distribution can be attained. The section of the external contour of the supporting protrusion 5 oriented orthogonally to the lock plate ensures a reliable stop to the cylindrical part of the sheathing 6 of the screw-on point 4 so that the supporting protrusion 5 does not glide off during supporting on the sheathing 6.

In the installed state of the motor vehicle lock screw ends protrude from the screw-on openings 7 of the screw-on points 4, equipped in particular with a thread inside the motor vehicle lock, i.e. from the lock plate 3 upwards. The supporting protrusion 5 can also additionally support itself on this protruding screw end.

The invention claimed is:

1. A motor vehicle lock comprising:

a rotary latch;

a pawl for latching the rotary latch in a latching position; and a lock plate with a screw-on point configured to receive a fastener for attaching the motor vehicle lock to a vehicle door or vehicle flap, wherein the screw-on point is formed as a sheathing of a screw-on opening, wherein the sheathing protrudes from the lock plate, wherein the rotary latch includes a support that is engageable against the screw-on point, wherein during normal operation, when the rotary latch is in the latching position, the support is spaced from the screw-on point so that the support and the screw-on point are non-contacting, wherein during a collision in which an overload acts on the rotary latch in the latching position, the overload being greater than a force acting on the rotary latch during the normal operation, the rotary latch or an axis of the rotary latch is deformed so that the support of the rotary latch comes into direct contact with the screw-on point, whereby the screw-on point both connects the motor vehicle lock to the vehicle door or vehicle flap and supports the rotary latch during the collision, and wherein the sheathing protruding from the lock plate is funnel-shaped.

2. The motor vehicle lock according to claim 1, wherein the rotary latch forms a supporting protrusion as the support.

3. The motor vehicle lock according to claim 1, wherein the support, when the rotary latch is in the latching position, has a surface that is arranged proximate the screw-on point without an interposed part between the surface and the screw-on point.

4. The motor vehicle lock according to claim 1, wherein the sheathing protruding from the lock plate is collar-shaped, cylindrical or funnel-shaped.

5. The motor vehicle lock according to claim 1, wherein the support supports itself on a screw on the screw-on point.

6. The motor vehicle lock according to claim 1, wherein the support and the screw-on point have complementary contours.

7. The motor vehicle lock according to claim 1, wherein the support is arranged on a load arm of the rotary latch.

8. The motor vehicle lock according to claim 1, wherein the support extends radially to a rotary latch axis.

9. The motor vehicle lock according to claim 8, wherein a radial extension of the support corresponds to at least 0.5-fold and a maximum of 2.0-fold of a diameter of the screw-on opening.

10. The motor vehicle lock according to claim 9, wherein the support extends to a radial side in an arch shape in a circumferential direction to the rotary latch axis, with expansion in a circumferential direction of at least 1.0-fold and a maximum of 2.0-fold of the diameter of the screw-on opening or the sheathing.

11. The motor vehicle lock according to claim 1, wherein a thickness of the support is less than a thickness of a main body portion of the rotary latch.

12. The motor vehicle lock according to claim 1, wherein the screw-on point is located on a side of a rotary latch that faces an inlet of an inlet slot of the lock plate.

13. The motor vehicle lock according to claim 1, wherein a pivot bearing or the axis of the rotary latch is mounted by a rivet connection with the lock plate.

14. The motor vehicle lock according to claim 1, wherein the lock plate or a lock case with the lock plate are made from a sheet metal.

15. The motor vehicle lock according to claim 1, wherein the sheathing is formed as part of the lock plate, the sheathing being formed of a material that forms the lock plate.

16. The motor vehicle lock according to claim 1, wherein the support is bonded to a main body of the rotary latch.

* * * * *